US008800223B2

(12) United States Patent
Ryan et al.

(10) Patent No.: US 8,800,223 B2
(45) **Date of Patent: *Aug. 12, 2014**

(54) FENESTRATION UNIT WATER RESTRICTOR AND METHOD

(71) Applicant: Pella Corporation, Pella, IA (US)

(72) Inventors: Aaron J. Ryan, Pella, IA (US); Jonathan S. Hoogland, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/762,975

(22) Filed: Feb. 8, 2013

(65) Prior Publication Data

US 2013/0212961 A1 Aug. 22, 2013

Related U.S. Application Data

(63) Continuation of application No. 12/751,613, filed on Mar. 31, 2010, now Pat. No. 8,375,658.

(51) Int. Cl.
*E06B 7/14* (2006.01)

(52) U.S. Cl.
USPC ..... 52/209; 49/408; 49/471; 49/504; 160/44; 52/210; 52/212

(58) Field of Classification Search
USPC ..... 52/208–217, 302.7, 204.52, 204.6, 52/204.593, 204.595, 204.597, 204.71, 52/302.1, 302.3, 302.6; 160/44; 49/408, 49/471, 406, 504, 476.1
See application file for complete search history.

(56) References Cited

U.S. PATENT DOCUMENTS

| | | | | |
|---|---|---|---|---|
| 3,184,806 | A * | 5/1965 | Bragman | 49/226 |
| 3,745,707 | A | 7/1973 | Herr | |
| 4,125,141 | A | 11/1978 | Stillwell | |
| 4,528,788 | A | 7/1985 | Yackiw et al. | |
| 4,891,921 | A * | 1/1990 | Governale | 52/207 |
| 4,922,661 | A | 5/1990 | Dallaire et al. | |
| 5,341,600 | A | 8/1994 | Heppner | |
| 5,469,666 | A | 11/1995 | Lewis, Jr. | |
| 6,243,999 | B1 | 6/2001 | Silverman | |
| 6,374,557 | B1 * | 4/2002 | O'Donnell | 52/209 |
| 6,427,286 | B1 | 8/2002 | Erskine | |
| 6,789,359 | B2 | 9/2004 | Bauman et al. | |
| 6,883,279 | B2 * | 4/2005 | Fukuro et al. | 52/209 |
| 8,033,056 | B2 * | 10/2011 | Wernlund et al. | 49/408 |
| 8,375,658 | B2 * | 2/2013 | Ryan et al. | 52/209 |
| 2006/0150521 | A1 | 7/2006 | Henry et al. | |
| 2007/0227430 | A1 | 10/2007 | D'Eon | |
| 2008/0110100 | A1 | 5/2008 | Heppner | |
| 2010/0162644 | A1 | 7/2010 | Campbell et al. | |

FOREIGN PATENT DOCUMENTS

| | | | |
|---|---|---|---|
| WO | WO 9508041 | A1 * | 3/1995 |
| WO | W02009026634 | A1 | 3/2009 |

* cited by examiner

*Primary Examiner* — Jeanette E. Chapman
(74) *Attorney, Agent, or Firm* — Faegre Baker Daniels LLP

(57) ABSTRACT

A water restrictor adapted to control water diversion from one or more channels in a lower member of a fenestration unit, such as a prehung sliding door or window.

16 Claims, 6 Drawing Sheets

FENESTRATION UNIT WATER RESTRICTOR AND METHOD

CROSS-REFERENCE TO RELATED APPLICATION

This application claims the benefit of U.S. Non-Provisional application Ser. No. 12/751,613, filed Mar. 31, 2010, which is herein incorporated by reference in its entirety.

BACKGROUND

Water ingress into fenestration units, which include both doors and windows, is one consideration in product design, construction, and installation. For example, in order to reduce the likelihood of moisture ingress into a dwelling or other structure, door and window assemblies include sealing systems (e.g., gaskets, flanges, and the like) between a unit's frame and panel(s). As might be expected, moisture intrusion is more problematic in situations where there is increased atmospheric moisture and pressure (e.g., as is often the case near oceans or during rain storms).

SUMMARY

Various embodiments described herein address a water restrictor adapted to control water diversion from one or more channels in a sill member of a fenestration unit, such as a prehung sliding door or window.

For example, some embodiments relate to a multi-panel fenestration unit that includes a frame, a first panel, a second panel, and a first water restrictor. The frame includes top, bottom and, two side members, the bottom member having a first end, a second end, a front, and a back and defining a length between the first and second ends and a width between the front and the back. The bottom member includes a first support and a second support each extending along the length of the bottom member, the second support being spaced laterally in front of the first support to define a channel between the first and second supports that extends along the length of the bottom member. The first panel has a first side and a second side and is maintained by the first support. The second panel is slidably mounted to the second support such that the second panel is adapted to slide open to a position in front of the first panel and to slide closed to a position adjacent to the first panel. The first water restrictor is secured in the channel at an intermediate position between the first and second ends of the bottom member, the first water restrictor being configured to restrain water flow in the channel.

While various embodiments are disclosed herein, still other embodiments will become apparent to those skilled in the art from the following detailed description, which shows and describes various examples for understanding. Accordingly, the drawings and detailed description are to be regarded as illustrative in nature and not restrictive.

Figure 1:
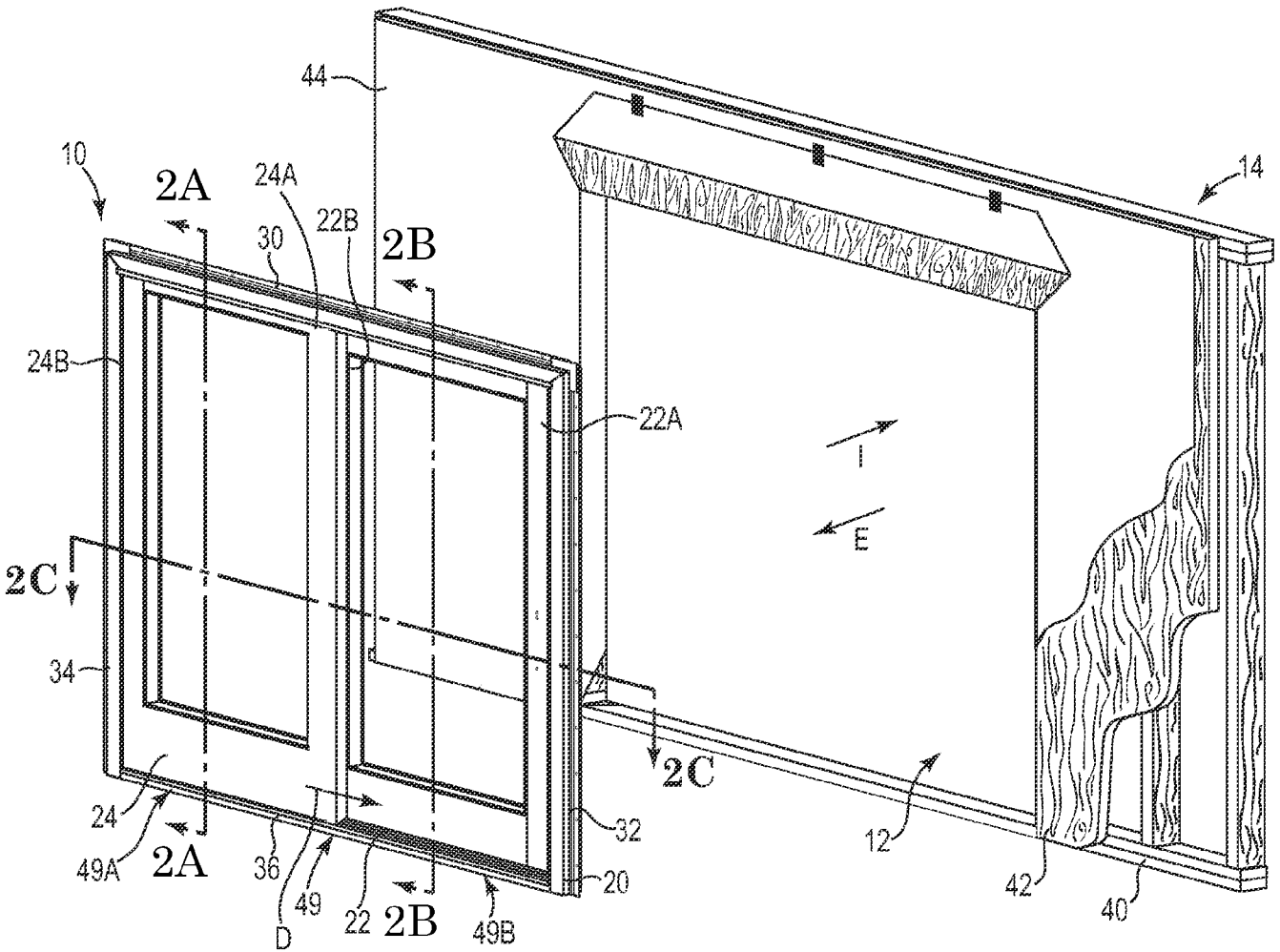
FIG. 1 shows a fenestration unit for closing a fenestration in a structure, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Various embodiments described herein address a water restrictor adapted to control water diversion from one or more channels in a sill member of a fenestration unit, such as a prehung sliding door or window. For example, observation has shown that in some sliding doors and windows, during rain storm conditions water sheets down the panels where there is a first panel which is at an offset on an interior side of a second panel maintained on a track. As the water sheets down the first panel, it collects in the sill next to the track and travels under the second panel, bringing water in close proximity to weather sealing between the second panel and the frame and between the second panel and the first panel. If an air leak is present in the weather sealing near the sill, the water has a tendency to travel to an interior side of the seal. Moreover, at higher differential pressures (e.g., during high winds where external pressures are increased), the potential for water ingression is aggravated. Some embodiments described herein help restrict water flow along the sill and facilitate water diversion therefrom. Various additional or alternate features and advantages should be understood with reference to the following description.

FIG. 1 shows a fenestration unit 10 for installation in an opening 12 in a structure 14 having an exterior side E and an interior side I, according to some embodiments. As shown, the fenestration unit 10 includes a frame 20, a first panel 22, and a second panel 24. The frame 20 includes a top member 30, a first side member 32, a second side member 34, and a bottom member 36. In some embodiments, the top member 30 is a head jamb, the first and second side members 32, 34 are jambs, the bottom member 36 is a sill, the first panel 22 is a fixed panel, and the second panel 24 is a vent panel that slides on the bottom member 36. The structure 14 optionally includes a stud wall 40, a sheathing layer 42, and a barrier layer 44. Though not shown, additional or alternative assembly components, such as flashing, for example, are contemplated.

Additional or alternative fenestration unit features are described in literature and embodied in products available from Pella Corporation of Pella, Iowa, including those presently sold under the trade name, "DESIGNER SERIES," "ARCHITECT SERIES," AND "PROLINE SERIES." Examples of sliding glass door and sliding glass window products are found in the "Pella 2010 Architectural Design Manual, Division 08—Openings, Windows and Doors," pages K-22 and 10-57, -59, available at www.PellaADM.com, the contents of which is incorporated herein by reference in its entirety.

Figure 2A:
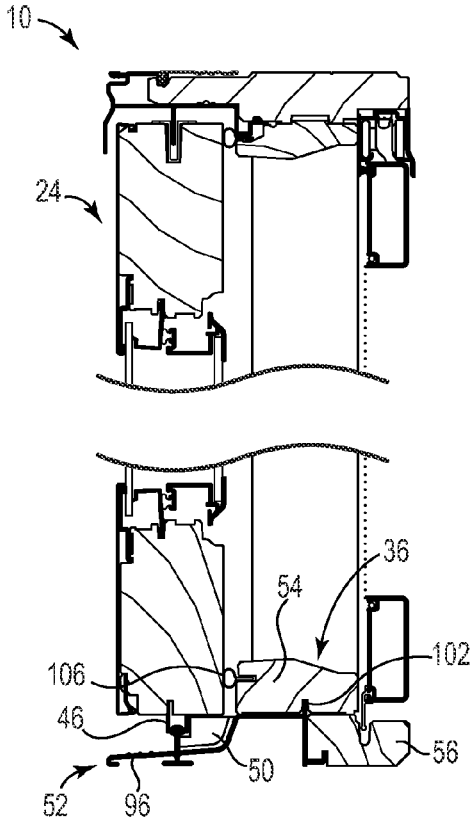
FIGS. 2A, 2B, and 2C are sectional views of the fenestration unit of FIG. 1, according to some embodiments.
Figure 2B:
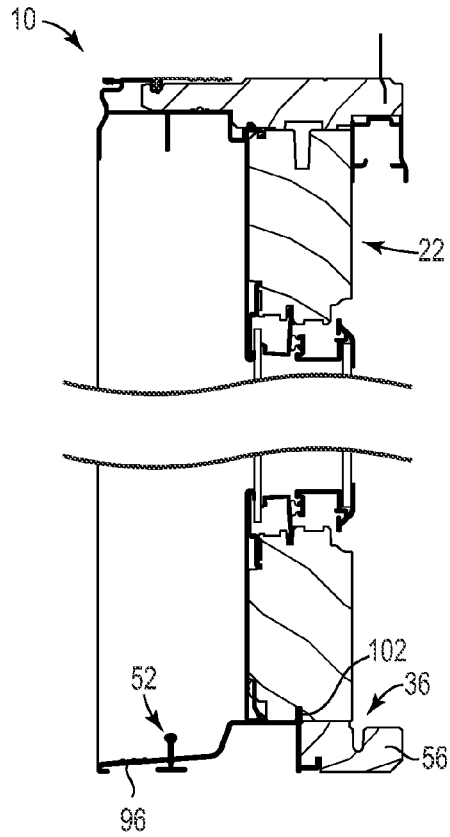
Figure 2C:
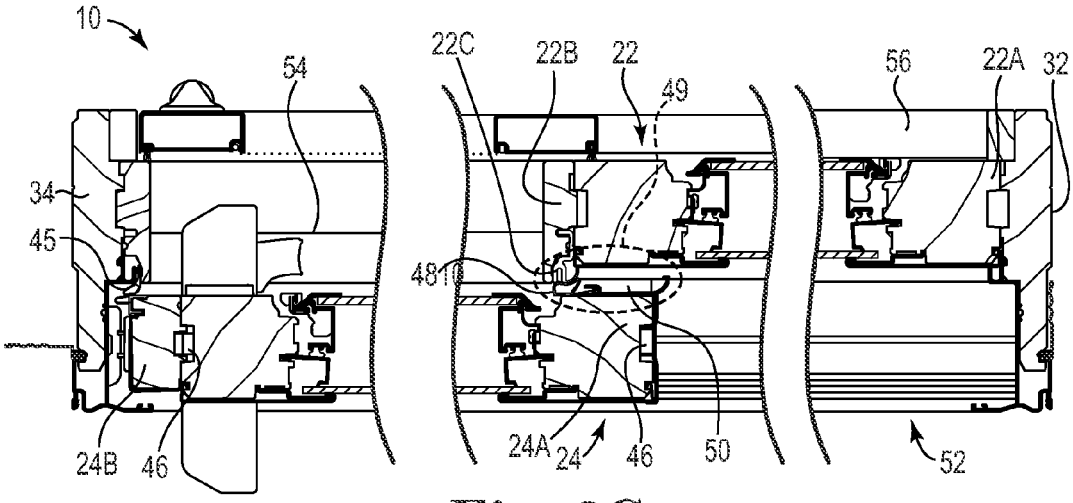

FIG. 2A is a section view along line 2A-2A in FIG. 1, FIG. 2B is a section view along line 2B-2B in FIG. 1 (with the second panel 24 removed), and FIG. 2C is a section view along line 2C-2C in FIG. 1. As shown in FIG. 2C, the second side member 34 includes a frame edge seal 45 extending substantially vertically along the second side member 34, according to some embodiments.

As shown in FIG. 1, the first panel 22 defines a first side 22A and a second side 22B. As shown in FIGS. 2B and 2C, the first panel 22 is secured, for example fixed, to the first side member 32 and the bottom member 36. The first panel 22 optionally includes an edge seal 22C extending substantially vertically along the first panel 22.

As shown in FIG. 2A, the second panel 24 defines a first side 24A and a second side 24B and is slidably mounted to the bottom member 36, the second panel 24 including one or more rollers 46 (e.g., adjacent each of the first and second sides 24A, 24B of the second panel 24) that assist a user when translating, or sliding the second panel 24 over the bottom member 36. As shown in FIG. 2C, the second panel 24 optionally includes an edge seal 48 that extends substantially vertically along the first side 24A of the second panel 24. The edge seal 48 optionally engages the first panel 22 when the second panel 24 is in a closed position as shown in FIG. 1, where the second panel 24 is positioned laterally adjacent the first panel 22 with an overlapping region 49 between the first and second panels 22, 24 at an intermediate position along the bottom member 36 between the first and second side members 32, 34.

As shown in FIG. 2A, the bottom member 36 includes a water restrictor 50, a base 52 into which the water restrictor 50 is received, a threshold 54 maintained by the base 52, and a foot 56 maintained by the base 52. The water restrictor 50 is optionally formed of a variety of materials, including polymeric materials, such as a butyl or silicone material, for example. The base 52 is optionally formed of a variety of materials, including metals such as aluminum, for example. In some embodiments, the base 52 is formed via an extrusion process, such that the base 52 defines a substantially continuous longitudinal profile. In alternate terms, the transverse cross-section of the base 52 is substantially continuous along the length of the base 52. The foot 56 and the threshold 54 are optionally formed of a variety of materials, including wood materials, for example. The foot 56 and the threshold 54 also optionally define substantially continuous longitudinal profiles as desired.

Figure 3:
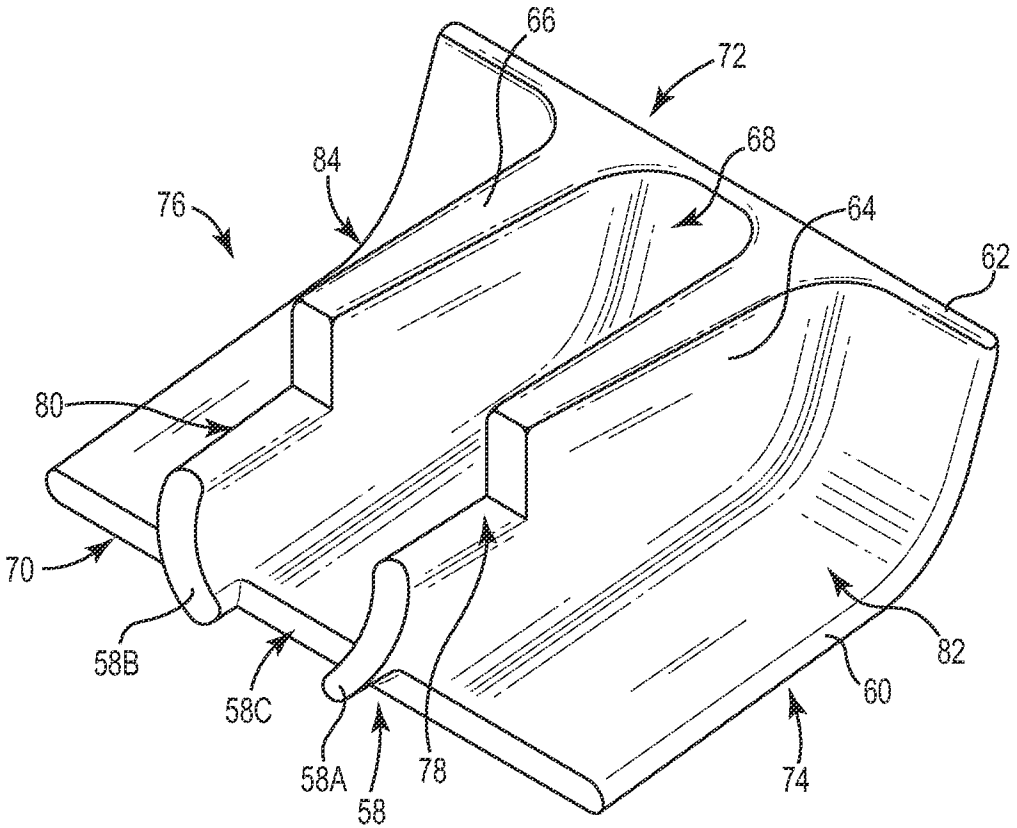
FIG. 3 shows a water restrictor of the fenestration unit of FIG. 1, according to some embodiments.

FIG. 3 is a perspective view of the water restrictor 50, according to some embodiments. As shown, the water restrictor 50 includes a front projection 58, a lower flange 60, also described as a lower web, a rear flange 62, also described as a rear web, a first wall 64, and a second wall 66, also described as side walls. The water restrictor 50 defines a gap 68 between the first and second walls 64, 66 and the water restrictor 50 has a front 70, a back 72, a first side 74, and a second side 76. In some embodiments, the first and second walls 64, 66 project upwardly and are substantially vertically oriented, each including a corner chamfer 78, 80, respectively, toward the front 70 opposite the rear flange 62. As described in greater detail below, the water restrictor 50 provides means for diverting water flow in the bottom member 36 away from weather sealing located at the bottom of the second panel 24.

Although two walls 64, 66 are shown, in other embodiments a single wall or more than two walls are employed. As shown, the first and second walls 64, 66 are substantially the same size and shape and are connected by the lower flange 60 and the rear flange 62, the lower flange 60 extending beyond the first and second walls 64, 66 to define first and second side pockets 82, 84 adjacent the first and second sides 74, 76, respectively, of the water restrictor 50. In some embodiments, the lower and rear flanges 60, 62, as well as the front projection 58, are configured to facilitate seating the water restrictor 50 in the base 52.

The front projection 58 optionally extends beyond the end of the lower flange 60 and includes two opposed, arcuately-shaped and forwardly projecting fingers 58A, 58B adapted to be inserted in a circular or semi-circular opening, for example, although other shapes are contemplated (square fingers for a square opening, and others). The front projection 58 also optionally defines a recess 58C with the lower flange 60 that facilitates water flow out of the gap 68 through the base 52.

Figure 4:
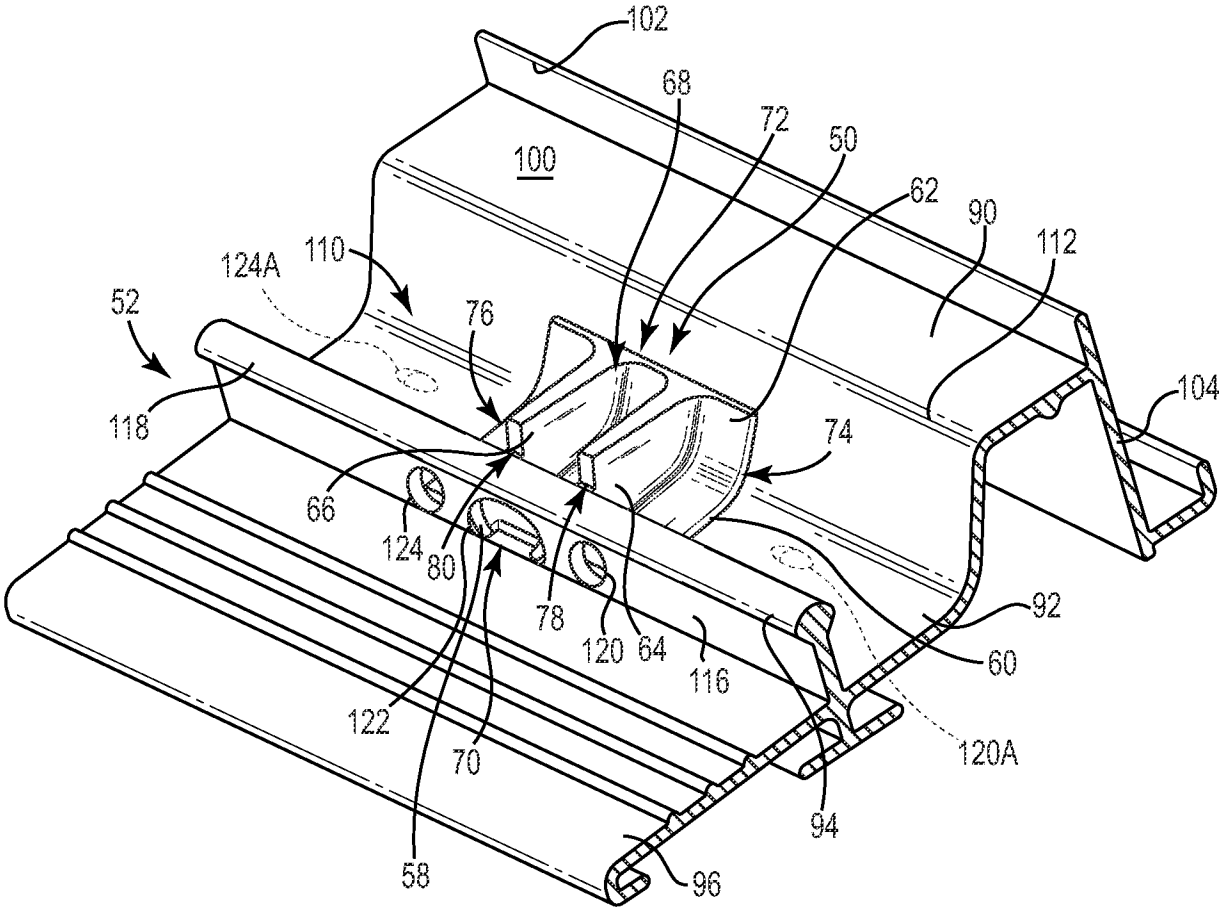
FIG. 4 shows the water restrictor of FIG. 3 installed in a base of the fenestration unit of FIG. 1, according to some embodiments.

FIG. 4 is a perspective view of the water restrictor 50 as received in a portion of the base 52 under the overlapping region 49 (FIG. 2C) defined by the first and second panels 22, 24. As described in greater detail, the water restrictor 50 is configured to provide three distinct drain paths from the base 52. In some embodiments, multiple water restrictors are present at multiple locations along the base 52 providing additional and/or alternate drain paths. For example, FIG. 4 is also optionally representative of a perspective view of second and third water restrictors substantially similar to the water restrictor 50 that are received in a portion of the base 52 at quarter-length regions 49A, 49B shown in FIG. 1, where region 49 is optionally characterized as a mid-length or half-length region.

In some embodiments, the base 52 is formed with a substantially continuous transverse cross-section along the length of the base 52. In other words, a substantial portion of the length of the base 52 is substantially continuous in transverse cross-section, where intermittent features, such as drainage holes, are also present. For example, the base 52 is optionally formed as part of an extrusion process resulting in a substantially continuous transverse cross-section, with intermittent portions of the base 52 being subsequently modified as desired (e.g., drilled, welded, or formed).

As shown, the base 52 includes a first, rear raised portion 90, also described as a first panel support, an intermediate portion 92, a second, front raised portion 94, also described as a second panel support, and a front step portion 96. The intermediate portion 92 and the front step portion 96 are generally depressed, or at a reduced height relative to the rear and front raised portions 90, 94.

In some embodiments, the rear raised portion 90 defines a support surface 100, an upper retainer 102, and a lower retainer 104. The support surface 100 is optionally substantially flat, the upper retainer 102 projecting upwardly and being a substantially vertical flange, and the lower retainer 104 is optionally a substantially J-shaped flange, or L-shaped flange. The upper retainer 102 is configured to assist with positioning and/or securing the first panel 22 relative to the support surface 100. The lower retainer 104 is configured to assist with positioning and/or securing the foot 56 relative to the base 52.

As shown, the intermediate portion 92 defines an elongate channel 110, or gutter, with the rear and front raised portions 90, 94. In some embodiments, the intermediate portion 92 is angled downward (e.g., between about a 10 and about a 20 degree downward tilt) and connects to the rear raised portion 90 at a rounded transition 112. In different terms, the front raised portion 94 is spaced laterally in front of the rear raised portion 90 to define the channel 110, which extends along the length of the bottom member 36, and in particular along the intermediate portion 92.

In some embodiments, the front raised portion 94 is adapted to serve as a raised track for the second panel 24. For example, the front raised portion 94 optionally includes an upwardly projecting web portion 116 oriented substantially vertically and having a terminal end 118 that is rounded, or otherwise shaped, to form a substantially complementary fit with the rollers 46 of the second panel 24. As shown in FIG. 4, in some embodiments, the upwardly projecting web portion 116 includes a first drain hole 120, an intermediate drain hole 122, and a third drain hole 124. The drain holes 120, 122, 124 are located toward the bottom of the upwardly projecting web portion 116 and facilitate draining of water from the channel 110. Although the drain holes 120, 122, 124 are shown in the upwardly projecting web portion 116, in other embodiments drain holes are additionally or alternatively formed in the intermediate portion 92, where a pair of drain holes 120A, 124A in the intermediate portion 92 are designated in broken lines in FIG. 3.

As shown in FIGS. 2A and 2B, the front step portion 96 is optionally angled downward to encourage water drainage (e.g., between about a 10 and about a 20 degree downward tilt). The front step portion 96 includes treading or other non-slip features as desired.

In some embodiments, the threshold 54 is formed of wood or other appropriate material, is secured to the upper retainer 102 of the base 52, and extends from the first panel 22 longitudinally along the base 52 to the second side member 34 (FIG. 1). As shown in FIG. 2A, the threshold 54 includes a lower seal 106 that extends along the threshold 54 and seals the threshold 54 to the second panel 24 when the second panel 24 is moved to the closed position. In turn, the foot 56 is also optionally formed of wood or other appropriate material, is secured to the lower retainer 104, and extends longitudinally along the base 52 between the first and second side members 32, 34 (FIG. 1), according to some embodiments.

Some methods of constructing the fenestration unit 10 and diverting water from the channel 110 in the bottom member 36 of the fenestration unit 10 include securing the top member 30, the bottom member 36, the first side member 32, and the second side member 34 together to form the frame 20.

In some embodiments, the first and second panels 22, 24 are secured to the frame 20, where the first panel 22 is fixedly secured to the frame 20. In other words, the first panel 22 is maintained by the rear raised portion 90 and is substantially prevented from sliding or otherwise moving relative to the frame 20. In other embodiments, however, the first panel 22, is movably secured to the frame 20. For example, the rear raised portion 90 is optionally configured similarly to the front raised portion 94 with the support surface 100 being configured as a track on which the first panel 22 is able to ride, or slide.

In some embodiments, the second panel 24 is slidably secured to the frame 20 with the rollers 46 of the second panel 24 riding on the front raised portion 94 of the bottom member 36. For example, the second panel 24 is optionally maintained by the front raised portion 94 or otherwise mounted to the frame 20 such that the second panel 24 is able to slide along the bottom member 36 to an open position in front of the first panel 22 in the direction D shown in FIG. 1.

In some embodiments, drain holes 120, 122, 124 are formed in the front raised portion 94 and the water restrictor 50 is inserted or otherwise seated into the base 52 to divert water flow in the channel 110 through the drain holes 120, 122, 124, where water on the first side 74 of the water restrictor 50 is dammed by the first wall 64 and diverted out of the first drain hole 120, water on the second side 76 of the water restrictor 50 is dammed by the second wall 66 and diverted out of the third drain hole 124, and water that overflows the first and/or second walls into the gap 68 is diverted out of the intermediate hole 122, for example.

In some embodiments, the front projection 58 of the water restrictor 50 is inserted partially into the intermediate hole 122 to help ensure that water in the gap 68 flows out of the intermediate drain hole 122 by helping seal the gap 68 from the first and second side pockets 82, 84. The recess 58C optionally helps encourage water to flow from the gap 68 by providing a lower path from the water restrictor 50 out of the intermediate drain hole 122. The first and second walls 64, 66 are positioned substantially transversely in the channel 110 to block the channel 110. The bottom of the water restrictor 50, the lower flange 60 in some embodiments, optionally forms a seal with the base 52 (e.g., via physical contact alone or through the addition of adhesives/sealants). In turn, the back 72 of the water restrictor 50, the rear flange 62 in some embodiments, also optionally forms a seal with the base 52 (e.g., via physical contact alone or through the addition of adhesives/sealants). In some embodiments, the water restrictor is removably secured in the base 52 (e.g., via friction and/or interference fit) and in other embodiments is more permanently affixed to the base 52 (e.g., via adhesives or mechanical fasteners).

Figure 5:
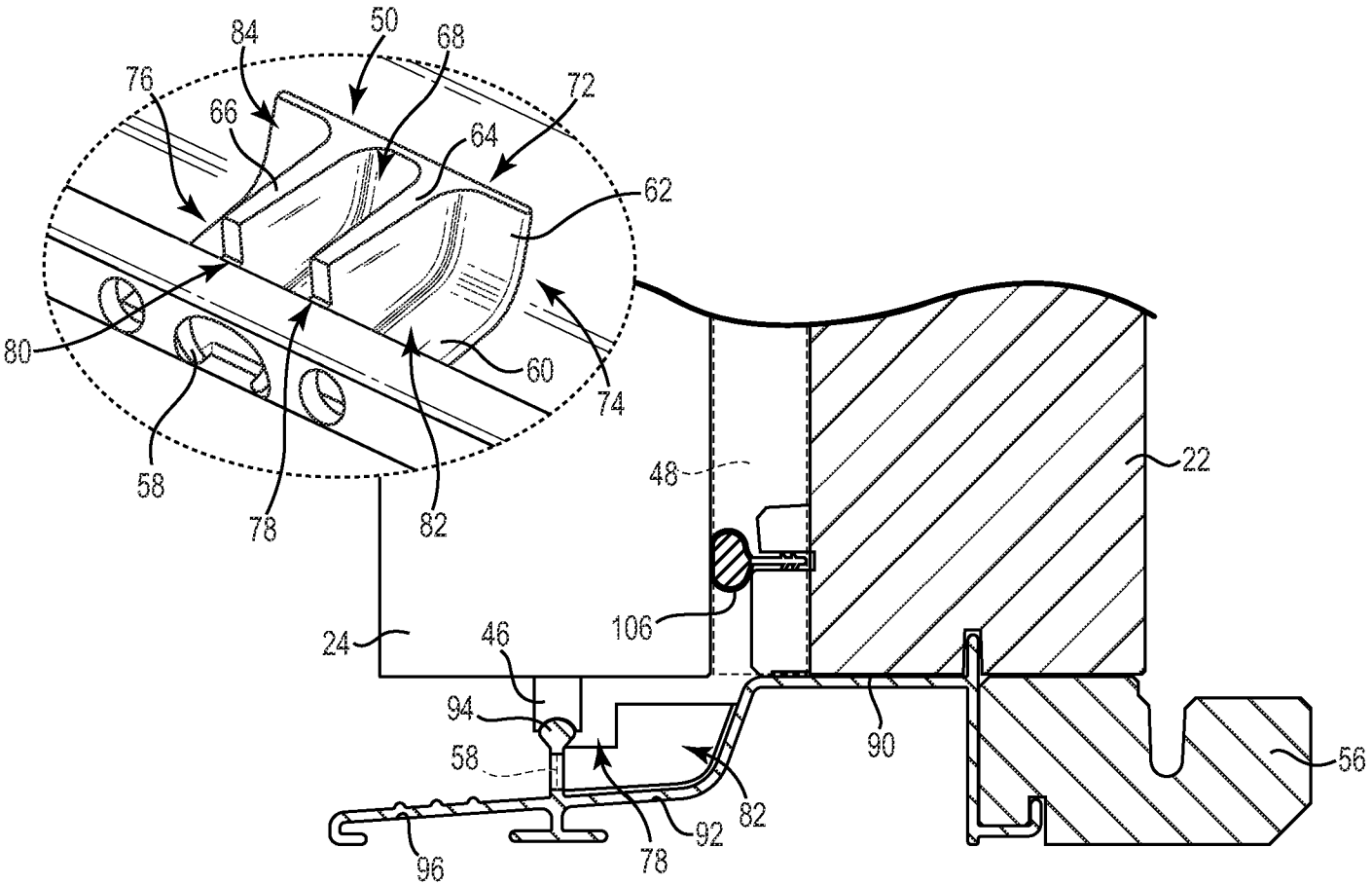
FIG. 5 is a sectional view of the fenestration unit of FIG. 1 along with a portion of FIG. 4 reproduced in the view of FIG. 5 for ease of understanding, according to some embodiments.

FIG. 5 is a sectional view along line 2B-2B of FIG. 1 with the second panel 24 shown. As understood with reference to FIGS. 4 and 5 and the foregoing description, by positioning the water restrictor 50 in the channel 110 between the first and third drain holes 120, 124 water on the exterior side E sheeting down unit 10 (e.g., the first panel 22), for example during a rain storm, enters the channel 110, but is less apt to flow across the water restrictor 50 to the second side 76 of the water restrictor 50 and below the second panel 24. And, even if water is present in the channel 110 on the second side 76 of the water restrictor 50, the channel 110 is less likely to overflow or fill to a height sufficient to wet out the weather sealing under the second panel 24 (e.g., lower seal 106) and/or at the edges of the panel 24A, 24B and in particular, at the corners (e.g., at the lower ends of edge seals 45, 48, 22C).

In some embodiments, additional water restrictors substantially similar to the water restrictor 50 are inserted into the channel 110 of the base 52, for example at regions 49A and/or 49B to further enhance drainage performance, with holes substantially similar to holes 120, 122, 124 formed at the region(s) shown in FIG. 1 as well.

Regardless, according to some embodiments, by reducing the chance of wetting out the weather sealing and reducing overall water volume under the second panel 24, the chance of water ingress from the exterior side E into the interior side I is substantially reduced, enhancing performance of the unit 10.

Figure 6:
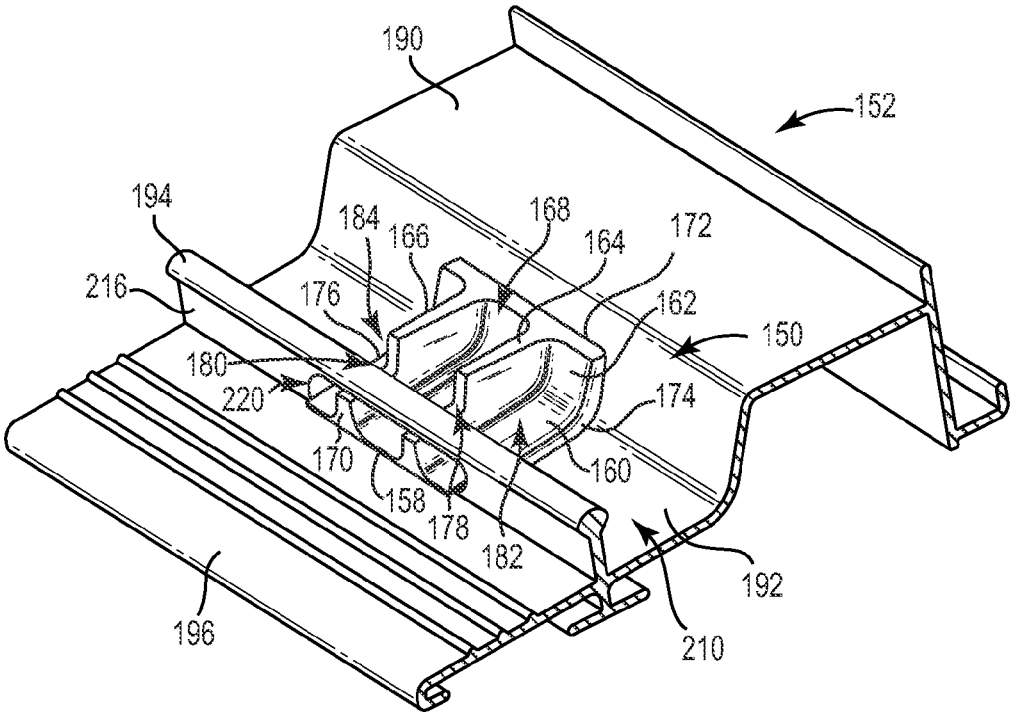
FIG. 6 shows another water restrictor installed in another base of a fenestration unit, according to some embodiments.

FIG. 6 shows another water restrictor 150 installed in a base 152, according to some embodiments. As described in greater detail below, the water restrictor 150 is configured to provide three separate drain paths from a single, contiguous outlet from the base 152.

As shown, the water restrictor 150 includes a front projection 158, a lower flange 160, also described as a lower web, a rear flange 162, also described as a rear web, a first wall 164, and a second wall 166, also described as side walls. The water restrictor 150 defines a gap 168 between the first and second walls 164, 166 and the water restrictor 150 has a front 170, a back 172 a first side 174, and a second side 176. In some embodiments, the first and second walls 164, 166 project upwardly and are substantially vertically oriented, each including a corner chamfer 178, 180, respectively, toward the front 170 opposite the rear flange 162. The water restrictor 150 provides means for diverting water flow through the base 152 and away from the weather sealing located at a bottom of a panel.

Although two walls 164, 166 are shown, in other embodiments a single wall or more than two walls are employed. As shown, the first and second walls 164, 166 are substantially the same size and shape and are connected by the lower flange 160 and the rear flange 162, the lower flange 160 extending laterally beyond the first and second walls 164, 166 to define first and second side pockets 182, 184 adjacent the first and second sides 174, 176, respectively, of the water restrictor 150. In some embodiments, the lower and rear flanges 160, 162 are configured to facilitate seating the water restrictor 150 in the base 152 in a complementary fit.

As compared to the forwardly projecting fingers 58A, 58B of the water restrictor 50, the front projection 158 of the water restrictor 150 includes both the elongated lower flange 160 and sidewalls 164, 166, with the corner chamfers 178, 180 being adapted to allow insertion of the sidewalls 164, 166 and lower flange 160 through the base 152.

As shown, the base 152 includes a first, rear raised portion 190, also described as a first panel support, an intermediate portion 192, a second, front raised portion 194, also described as a second panel support, and a front step portion 196. The intermediate portion 192 and the front step portion 196 are generally depressed, or at a reduced height relative to the rear and front raised portions 190, 194.

As shown, the intermediate portion 192 defines an elongate channel 210, or gutter, with the rear and front raised portions 190, 194. In some embodiments, the front raised portion 194 is adapted to serve as a raised track. As shown, an upwardly projecting web portion 216 of the front raised portion 194 includes an elongate drain hole 220 through the upwardly projecting web portion 216 facilitating drainage of water from the channel 210. Although the drain hole 220 is shown in the upwardly projecting web portion 216, in other embodiments drain holes are additionally or alternatively formed in the intermediate portion 192 as desired.

Assembly of the water restrictor 150 and the base portion 152 includes seating the water restrictor 150 in the channel 210 with the front projection 158 extending into the drain hole 220. As shown, the water restrictor 150 defines three segregated pathways for water to drain from the channel 210 through the drain hole 220, those segregated pathways corresponding to the gap 168, the first side pocket 182, and the second side pocket 184, respectively. As shown, the water restrictor 150 extends entirely across the channel 210, spanning the transverse cross-section of the channel to form a barrier that extends between the front raised portion 194 and the rear raised portion 190.

Figure 7:
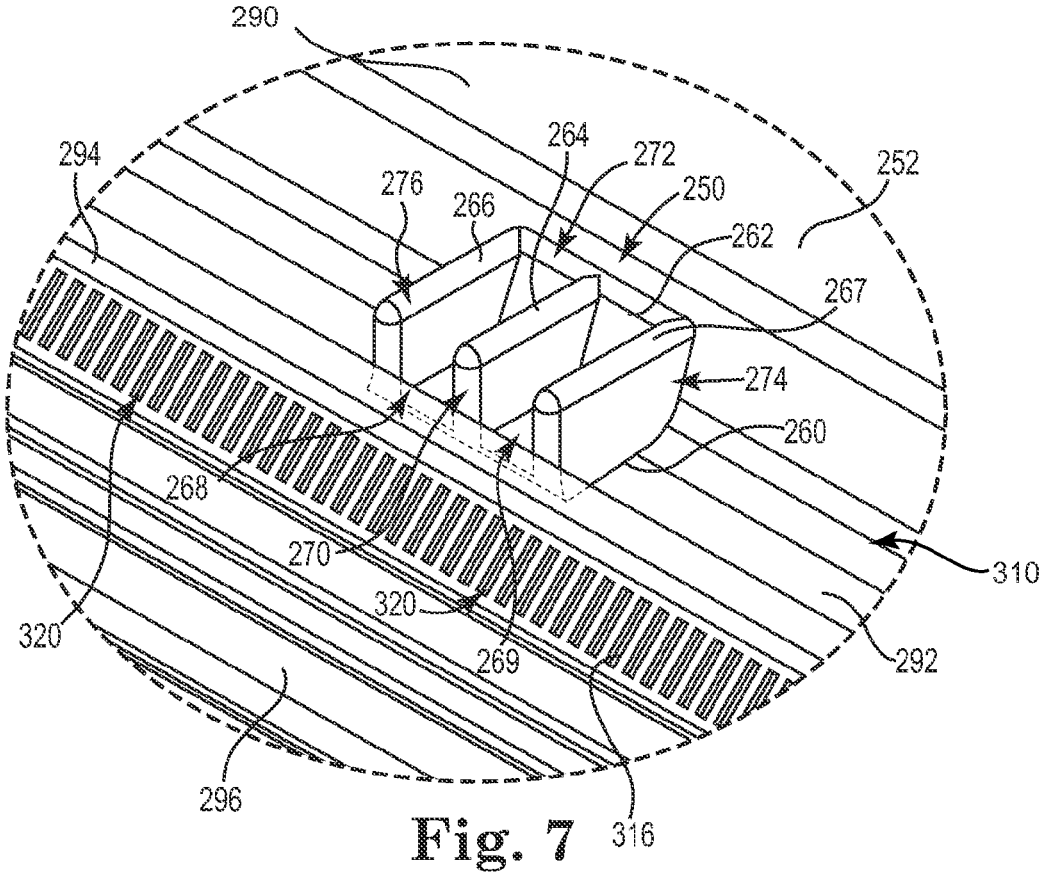
FIG. 7 shows yet another water restrictor installed in yet another base of a fenestration unit, according to some embodiments.

FIG. 7 shows another water restrictor 250 installed in a base 252, according to some embodiments. As described in greater detail below, the water restrictor 250 is configured to act as a partial dam in the base 252.

As shown, the water restrictor 250 includes a lower flange 260, also described as a lower web, a rear flange 262, also described as a rear web, a first wall 264, a second wall 266, and a third wall 267, each optionally being described as side walls. The water restrictor 250 defines a first gap 268 between the first and second walls 264, 266 and a second gap 269 between the first and third walls 264, 267, where the water restrictor 250 has a front 270, a back 272, a first side 274, and a second side 276. In some embodiments, the walls 264, 266, 267 are substantially vertically oriented. The water restrictor 250 provides means for diverting water flow through the base 252 and away from the weather sealing at a bottom of a panel.

Although three walls 264, 266, 267 are shown, in other embodiments a single wall, two walls, or more than three walls are employed, for example. As shown, the walls 264, 266, 267 are substantially the same size and shape and are connected by the lower flange 260 and the rear flange 262, the lower flange 260 terminating laterally at the second and third walls 266, 267 adjacent the first and second sides 274, 276, respectively, of the water restrictor 250. In some embodiments, the lower and rear flanges 260, 262 are configured to facilitate seating the water restrictor 250 in the base 252 in a complementary fit.

As compared to the front projection 58, 158 of the water restrictors 50, 150, the water restrictor 250 optionally terminates at the front 270 without any additional forward projection from the walls 264, 266, 267 and/or lower flange 260.

As shown, the base 252 includes a first, rear raised portion 290, also described as a first panel support, an intermediate portion 292, a second, front raised portion 294, also described as a second panel support, and a front step portion 296. The intermediate portion 292 and the front step portion 296 are generally depressed, or at a reduced height relative to the rear and front raised portions 290, 294.

As shown, the intermediate portion 292 defines an elongate channel 310, or gutter, with the rear and front raised portions 290, 294. In some embodiments, the front raised portion 294 is adapted to serve as a raised track and includes an upwardly projecting web portion 316 that is substantially vertically oriented. The front raised portion 294 is optionally formed as an inverted V, with a front of the web portion 316 projecting at an upward angle—extending substantially upwardly and rearwardly from the surrounding portions of the base 252 and a rear portion (hidden from view) projecting at an upward angle—extending upwardly and forwardly from the surrounding portions of the base 252 to meet the front of the web portion 316 at a peak.

In some embodiments, the upwardly projecting web portion 316 includes a plurality of drain holes 320 through the front and back of the upwardly projecting web portion 316. For example, as shown, a plurality of thin, substantially rectangular openings are formed through the front of the web portion 316 to help water flow from the channel 310. In some embodiments, the drain holes 320 are closely-spaced and extend for a total distance of at least 2 inches on either side of the water restrictor 250, at least 5 inches on either side of the water restrictor 250, or along substantially all the length of the web portion 316 as desired, although a variety of other configurations are also contemplated. As previously referenced, the drain holes 320 are optionally formed into both the front and back of the web portion 316 (i.e., through both faces of the inverted V).

Assembly of the water restrictor 250 and the base portion 252 includes seating the water restrictor 250 in the channel 310 so that the water restrictor 250 blocks a portion of the channel 310. By positioning the water restrictor 250 where the first and second panels overlap when the fenestration unit is closed, the water restrictor 250 helps slow water flow under the panel(s) and also encourages water flow from the drain holes 320. In other embodiments, the water restrictor 250 is configured to extend across the entire transverse cross-section of the channel 310 as desired.

Although various embodiments describe use of water restrictors with sliding doors, similar embodiments to those described address use of substantially similar water restrictors with other fenestration products as appropriate, such as sliding windows or hinged windows or doors. Additionally, various embodiments include multiple, sliding panels (e.g., three or more) with multiple channels formed between adjacent tracks or other support surface, those channels including one or more water restrictors such as those previously described. Various modifications and additions can be made to the exemplary embodiments discussed without departing from the scope of invention. For example, while the embodiments described above refer to particular features, the scope of invention also includes embodiments having different combinations of features and embodiments that do not include all of the described features.

While various embodiments have been described, the scope of invention is intended to embrace all alternatives, modifications, and variations that fall within the scope of the claims, together with all equivalents thereof.

What is claimed is:

1. A multi-panel fenestration unit comprising:

a frame including a top member, a bottom member, a first side member, and a second side member, the bottom member having a first end, a second end, a front, and a back and defining a length between the first and second ends and a width between the front and the back, the bottom member including a first raised portion and a second raised portion each extending along the length of the bottom member, the second raised portion being spaced laterally in front of the first raised portion to define a channel between the first and second raised portions that extends along the length of the bottom member;

a first panel having a first side and a second side and being maintained by the first raised portion;

a second panel slidably mounted to the second raised portion such that the second panel is adapted to slide open to a position in front of the first panel and to slide closed to a position adjacent to the first panel; and a first water restrictor secured in the channel at an intermediate position between the first and second ends of the bottom member, the first water restrictor comprising a first vertically oriented wall extending substantially across the channel to restrain water flow in the channel.

2. The multi-panel fenestration unit of claim 1, wherein the first water restrictor comprises a second vertically oriented wall extending across the channel.

3. The multi-panel fenestration unit of claim 2, wherein the first water restrictor comprises a front projection including a first forwardly projecting finger extending from the first vertically oriented wall and a second forwardly projecting finger extending from the second vertically oriented wall, wherein the first and second forwardly projecting fingers are arcuately-shaped and extend into in a flow passage defined by the bottom member, and wherein the flow passage has a shape that is circular or semi-circular.

4. The multi-panel fenestration unit of claim 2, wherein the first water restrictor comprises a front projection including a first forwardly projecting finger extending from the first vertically oriented wall and a second forwardly projecting finger extending from the second vertically oriented wall, wherein the front projection extends into in a flow passage defined by the bottom member, and wherein the first water restrictor defines three segregated pathways through the flow passage.

5. The multi-panel fenestration unit of claim 2, wherein the first water restrictor comprises a third vertically oriented wall extending across the channel, and wherein the bottom member defines a plurality of closely spaced flow passages extending through the second raised portion for a total distance of at least 2 inches on either side of the first water restrictor.

6. The multi-panel fenestration unit of claim 1, wherein the first water restrictor comprises a lower flange and a rear flange connected to the first vertically oriented wall, wherein the lower and rear flanges each form a seal with the bottom member.

7. The multi-panel fenestration unit of claim 1, wherein the first water restrictor extends entirely across the channel to form a barrier spanning from the first raised portion to the second raised portion.

8. The multi-panel fenestration unit of claim 1, wherein the second raised portion comprises a raised track having an upwardly extending web portion and a terminal end to form a complementary fit with rollers of the second panel.

9. The multi-panel fenestration unit of claim 1, wherein the first water restrictor comprises a front projection extending into a flow passage defined through the upwardly extending web portion of the second raised portion.

10. The multi-panel fenestration unit of claim 1, wherein the first water restrictor comprises:

a lower flange;

a rear flange connected to the lower flange, wherein the first vertically oriented wall is connected to the lower and rear flanges and extends vertically from the lower flange; and a second vertically oriented wall connected to the lower and rear flanges, extending vertically from the lower flange, and spaced from the first vertically oriented wall to define a gap bounded by the first vertically oriented wall, the second vertically oriented wall, the lower flange, and the rear flange, wherein a first side pocket is bounded by the first vertically oriented wall, the lower flange, and the rear flange, and wherein a second side pocket is bounded by the second vertically oriented wall, the lower flange, and the rear flange.

11. The multi-panel fenestration unit of claim 1, wherein the first water restrictor comprises:

a lower flange;

a rear flange connected to the lower flange, wherein the first vertically oriented wall is connected to the lower and rear flanges and extends vertically from the lower flange;

a second vertically oriented wall connected to the lower and rear flanges, extending vertically from the lower flange, and spaced from the first vertically oriented wall to define a first gap bounded by the first vertically oriented wall, the second vertically oriented wall, the lower flange, and the rear flange; and a third vertically oriented wall connected to the lower and rear flanges, extending vertically from the lower flange, and spaced from the second vertically oriented wall to define a second gap bounded by the third vertically oriented wall, the second vertically oriented wall, the lower flange, and the rear flange.

12. A water restrictor for use in a longitudinal channel of a multi-panel fenestration unit, the water restrictor comprising:

a lower flange;

a rear flange connected to the lower flange;

a first vertically oriented wall connected to the lower and rear flanges and extending vertically from the lower flange;

a second vertically oriented wall connected to the lower and rear flanges, extending vertically from the lower flange, and spaced from the first vertically oriented wall to define a gap bounded by the first vertically oriented wall, the second vertically oriented wall, the lower flange, and the rear flange, wherein a first side pocket is bounded by the first vertically oriented wall, the lower flange, and the rear flange, and wherein a second side pocket is bounded by the second vertically oriented wall, the lower flange, and the rear flange.

13. The water restrictor of claim 12, and further comprising:

a front projection including a first forwardly projecting finger extending from the first vertically oriented wall and a second forwardly projecting finger extending from the second vertically oriented wall, wherein the first and second forwardly projecting fingers are arcuately-shaped.

14. The water restrictor of claim 13, wherein the front projection defines a recess on the lower flange between the first and second vertically oriented walls.

15. The water restrictor of claim 12, and further comprising a first corner chamfer at a first front corner of the first vertically oriented wall and a second corner chamfer at a second front corner of the second vertically oriented wall.

16. The water restrictor of claim 12, wherein the gap, the first side pocket, and the second side pocket are each open on a top and a front of the water restrictor, wherein the first side pocket is open on a first side of the water restrictor, and wherein the second side pocket is open on a second side of the water restrictor.

* * * * *